United States Patent [19]

Daniel et al.

[11] Patent Number: 4,854,461

[45] Date of Patent: Aug. 8, 1989

[54] STORAGE BOX

[75] Inventors: Aaron E. Daniel, Nampa; Daniel P. Rule, Caldwell, both of Id.

[73] Assignee: Rule Steel Tanks, Inc., Caldwell, Id.

[21] Appl. No.: 273,833

[22] Filed: Nov. 21, 1988

[51] Int. Cl.[4] ..... B65D 6/00

[52] U.S. Cl. ..... 220/4 R; 220/75; 220/83

[58] Field of Search ..... 220/4 R, 4 F, 4 C, 83, 220/62, 75

[56] References Cited

U.S. PATENT DOCUMENTS

| | | | |
|---|---|---|---|
| 2,182,201 | 12/1939 | Harris | 220/75 X |
| 2,423,955 | 7/1947 | Widener | 220/4 F X |
| 3,648,877 | 3/1972 | Heft | 220/4 F |
| 3,831,799 | 8/1974 | Nutt | 220/4 F |
| 3,937,356 | 2/1976 | Schmidt, Sr. et al. | 220/4 R X |
| 4,730,746 | 3/1988 | Yankoff | 220/4 F |
| 4,785,957 | 11/1988 | Beck et al. | 220/4 F |

*Primary Examiner*—Steven M. Pollard

*Attorney, Agent, or Firm*—Paul F. Horton

[57] ABSTRACT

A storage box, particularly adapted for seed storage and handling, having folded corners and sides tapered from bottom to top. The box is provided with a base member having slots engageable by the tines of a fork lift and a horizontal top stacking flange which extends outwardly to the same dimensions as the base member for vertical stacking of the boxes. The box is preferably constructed of steel plate and the folded corners assure the strength and integrity of the box.

11 Claims, 1 Drawing Sheet

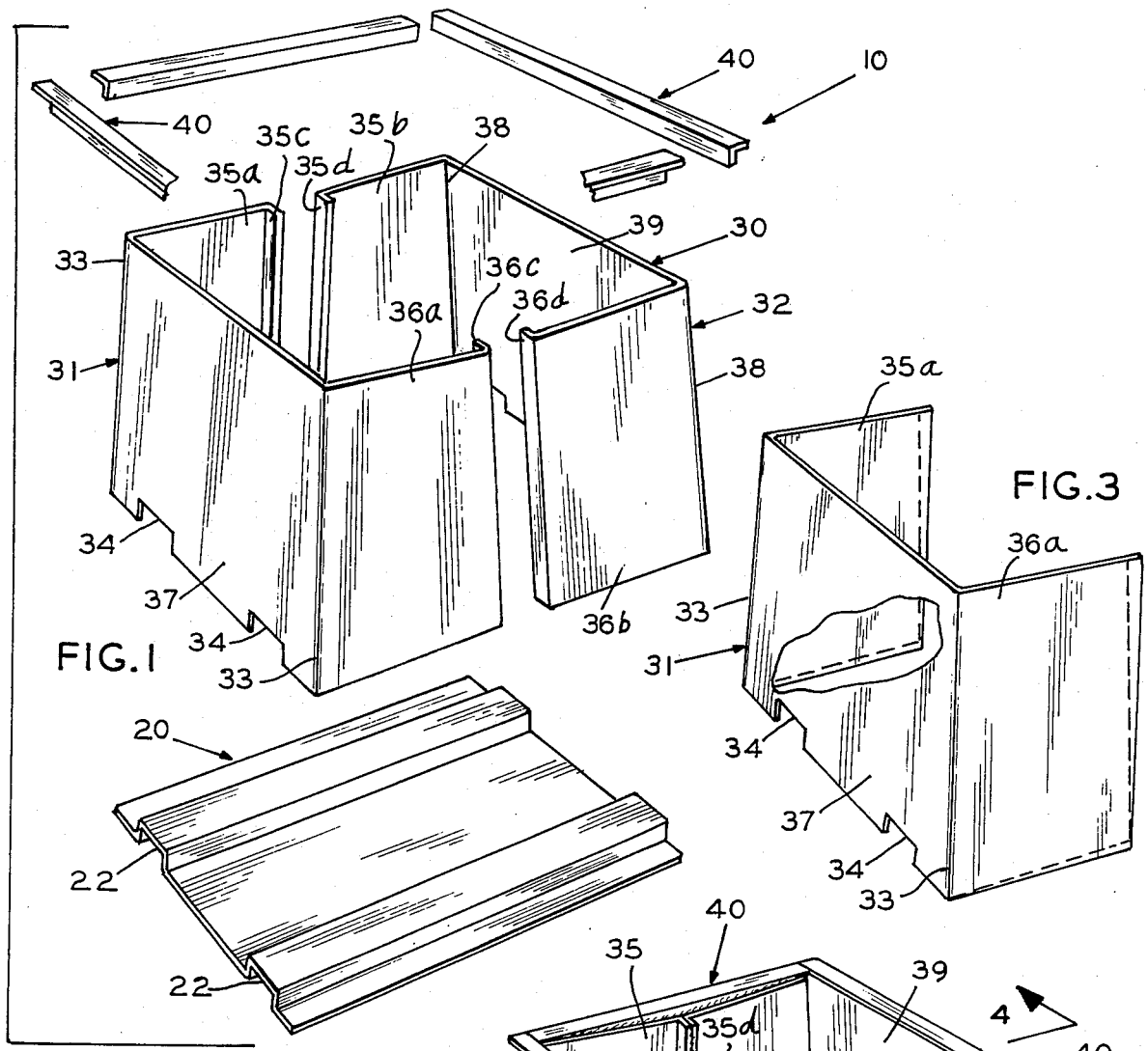
FIG. 1
FIG. 3
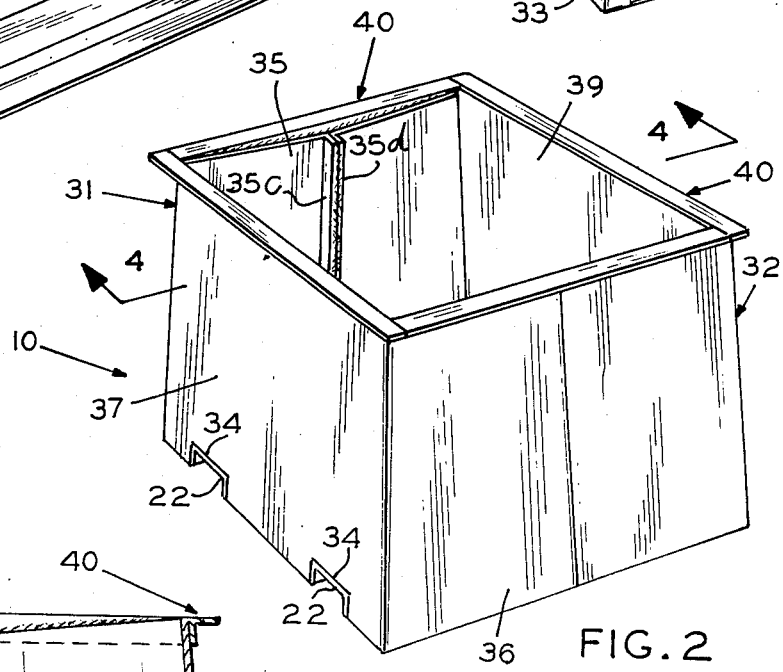
FIG. 2
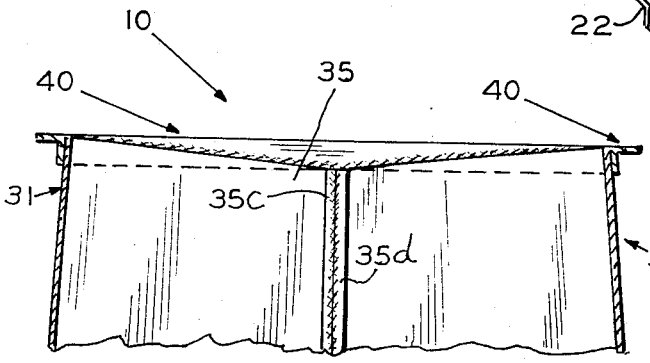
FIG. 4

STORAGE BOX

BACKGROUND OF THE INVENTION

1. Field of the Invention

This invention relates in general to storage boxes and in particular to seed boxes adapted for vertical stacking.

2. Description of the Prior Art

In the manufacture of seed boxes, which may hold from 2,000–4,000 pounds of seed each, it is highly desirable to make the boxes as light and the least costly as possible, and yet make them strong enough that vertical stacking of five or six loaded boxes will not cause the lower boxes to collapse.

Heretofore, seed boxes have been of two general types, both constructed of sheet steel. The first type, as typified by U.S. Pat. No. 2,664,219, issued to T. Schmidt, includes four vertical walls, folded corners, and stacking flanges top and bottom for placement of one box upon another. Such boxes also typically include stacking pins or handles so that one box does not fall within another. The requirement of stacking flanges, top and bottom, add to the weight and cost of the boxes and generally require greater storage space per unit volume because of the overhang of the flanges.

The second type of box currently in use, storing the most seed in the least space, are boxes having walls tapered from bottom to top; the top usually being about 3 inches less in width than the bottom. A stacking flange is then placed about the top periphery only of the box for stacking purposes. All known boxes of this tapered sided type include corner welds. The sides are simply cut to the desired tapered dimensions and then welded together at the corners. The primary problem with this tapered sided type of box is that typically the welds on the corners split with age, use, fatigue and crystallization, and then the box fails, which may result in an entire stack of boxes falling over. This is costly, as it ruins certified seed and split boxes may be dangerous to forklift operations.

Other patents of relevance are those of S. Dezawa, U.S. Pat. No. 4,381,842, showing a metal enclosure having four walls formed by folding a single plate; and B. D. Jones et al, U.S. Pat. No. 3,318,473 showing a dispensing bin.

SUMMARY OF THE INVENTION

The present invention overcomes these problems in the prior art by providing a seed storage box constructed of steel plate and comprising a base member and four walls welded thereto, the walls tapered from bottom to top and each of the walls connected to an adjacent wall by a folder corner. Folded corners without a weld are greatly desired. Such construction allows continuation of primary material, in turn allowing consistency, uniformity, no introduction of human error in welding, and no heat application building potential stress fractures in the weld and in the material. Besides having greater strength and integrity, the box of the present invention saves manhours in welding labor. It is therefore the primary object of the present invention to provide a tapered wall, folder corner seed box, hitherto unknown in the art.

BRIEF DESCRIPTION OF THE DRAWINGS

FIG. 1 is an exploded perspective view of one embodiment made according to the present invention.

FIG. 2 is a perspective view of the box of FIG. 1, shown assembled.

FIG. 3 is a perspective view of one of the unitary sections, showing the trim lines.

FIG. 4 is a partial cross-sectional view taken along lines 4—4 of FIG. 2.

DETAILED DESCRIPTION OF THE INVENTION

Referring now to the drawings, and to FIGS. 1 and 2, in particular, an embodiment to be preferred of a seed storage box 10, made according to the present invention is disclosed. Box 10 includes, generally, a base member 20; four walls, designated generally by the numeral 30; and a horizontal stacking flange 40 welded to the top of the walls.

Base member 20 is constructed of a sheet of mild steel, preferably of sixteen gauge, and is formed to define a substantially horizontal base platform having at least two parallel slots 22 for receiving fork tines of a forklift. The base member is rectangular in overall configuration and may be of any desired dimensions compatible with the walls which are welded thereto.

Walls 30 are formed from two unitary sections 31 and 32 of mild steel plate, preferably of eighteen gauge, shown to advantage in FIG. 1. Each of the sections is folded to define an end wall, tapered from bottom to top, and two tapered side wall portions. As shown in the figures, section 31 is folded to define corners 33 including end wall 37 therebetween, together with laterally spaced side wall portions 35*a* and 36*a*. End wall has a width along the top of the wall somewhat less than the width along the bottom of the wall, as for example forty five inches and forty eight inches, respectively. Section 32 is folded in like manner to define corners 38 with end wall 39 therebetween and side wall portions 35*b* and 36*b*. Side wall portions 35*a* and 35*b* and 36*a* and 36*b*, respectively, are planar with and in registry with one another for welding. For added strength, the free terminal ends of the side wall portions are bent to create abutting weld flanges 35*c* and 35*d* and 36*c* and 36*d*, respectively. Respective weld flanges are placed in abutment with one another and then seam welded to affix sections 31 and 32 together to create tapered side walls 35 and 36. The seam thus created on the exterior surface of the box may be spot welded together, if desired. Adjacent their bottom edge, end walls 37 and 39 are cut to provide form fitting slots 34 for receiving slots 22 of base member 20. All walls are then welded to the base member so that the walls are in sealing engagement with the base member.

For vertically stacking one box upon another, box 10 is provided about its uppermost periphery with a stacking flange 40. Flange 40 is preferably comprised of our angle irons, set on the same plane and at right angles to one another, having a preferable thickness of three-sixteenth of an inch. The angle irons are welded to the exterior top side and end walls to produce a flange having a horizontal, weight bearing, surface and having outer dimensions equal to the respective dimensions of base member 20, so that the base member of an upwardly, vertically spaced box will rest upon the stacking flange of an adjacent, lower box. It will be noted that the flange, in being welded to the outer surface of the walls, results in a smooth pouring surface at the interior top of the box.

In the manufacture of box 10, to form sections 31 and 32, a rectangular sheet of metal is used. In folding the corners at a slight angle inwardly from vertical from bottom to top to provide the proper taper, the side wall portions, for example side wall portions 35*a* and 36*a* of section 31, are tilted downwardly, leaving a gap from horizontal at the top of the wall portions and an overhang at the bottom of the wall portions. The overhang portions are simply cut off so that the bottom of the wall portions are in registry with the horizontal portions of base member 20 to which they are welded, as shown in FIG. 3. The gap at the top of the wall portions is not a problem in that the angle iron of stacking flange 40 fills in the top of the side wall portions as it is welded thereto, as may be seen in wall 35 of box 10, shown in FIGS. 2 and 4. Also, because of the downward tilt of the wall portions of side walls 35 and 36, the free terminal ends of wall portions 35*a*, 35*b*, 36*a*, and 36*b* should be cut to vertical, as shown by the dotted lines in FIG. 3, before bending to create the weld flanges.

Having thus described in detail a preferred embodiment of the present invention, it is to be appreciated and will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein.

We claim:

1. A storage box comprising:

a base member; and four walls affixed to and in sealing engagement with said base member, each of said walls tapered from bottom to top and each of said walls being folded to define tapered corners, said corners constructed of material unitary with adjacent wall portions.

2. The box as defined in claim 1 wherein said box is constructed of metal.

3. The box as defined in claim 2 wherein said box is constructed of steel.

4. The box as defined in claim 1 wherein said four walls are constructed of two unitary sections, affixed to one another, each section being folded to define an end wall and laterally spaced portions of opposing side walls.

5. The box as defined in claim 4 wherein each of said sections is provided with a flange in registry with a flange of the opposing section, said opposing flanges in abutting engagement with one another for affixing said sections together.

6. The box as defined in claim 1 further comprising a stacking flange affixed to and about the upper periphery of said walls.

7. The box as defined in claim 6 wherein the outer dimensions of said flange are substantially equal to the outer dimensions of said base member for registry between the base of one box and the flange of an underlying box, for vertical stacking.

8. The box as defined in claim 1 wherein said base member and at least two opposing walls define laterally spaced slots for the reception of tines of a forklift.

9. A storage box comprising:

a base member constructed of sheet steel;

two unitary sections constructed of sheet steel, each of said sections being folded to define an end wall tapered from bottom to top and two portions of opposing, laterally spaced side walls, tapered from bottom to top; said portions of said side walls of one section welded to portions of said side walls of another section and said endwalls and side walls welded to said base member to define a box having four walls tapered from bottom to top; and a stacking flange affixed to and about the upper periphery of said walls.

10. The box as defined in claim 9 wherein each of said sections is provided with a flange in registry with a flange of the opposing section, said opposing flanges in abutting engagement with one another for affixing said sections together.

11. The box as defined in claim 9 wherein said base member and at least two opposing walls define laterally spaced slots for the reception of tines of a forklift.

* * * * *